US008459404B2

(12) United States Patent
Murray et al.

(10) Patent No.: US 8,459,404 B2
(45) Date of Patent: Jun. 11, 2013

(54) LOUDSPEAKER

(75) Inventors: Michael Joseph Murray, West Roxbury, MA (US); Jacques S. Getzoyan, Milford, MA (US); James R. Paldino, Worcester, MA (US); Robert Preston Parker, Westborough, MA (US); Peter J. Wagner, II, Worcester, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 13/205,663

(22) Filed: Aug. 9, 2011

(65) Prior Publication Data

US 2013/0037344 A1 Feb. 14, 2013

(51) Int. Cl.
*A47B 81/06* (2006.01)

(52) U.S. Cl.
USPC ..... 181/199; 181/150; 181/148

(58) Field of Classification Search
USPC ..... 181/198, 199, 148, 152, 156; 381/341, 381/345, 349; D14/214
See application file for complete search history.

(56) References Cited

U.S. PATENT DOCUMENTS

| | | | | |
|---|---|---|---|---|
| 5,206,465 | A * | 4/1993 | Jung | 181/152 |
| 5,432,860 | A * | 7/1995 | Kasajima et al. | 381/349 |
| 5,809,154 | A | 9/1998 | Polk | |
| 5,898,788 | A * | 4/1999 | Kim | 381/341 |
| 6,377,684 | B1 * | 4/2002 | Lucey et al. | 379/430 |
| 7,162,049 | B2 * | 1/2007 | Polk, Jr. | 381/345 |
| 7,870,928 | B1 * | 1/2011 | Jiang et al. | 181/148 |
| 7,878,296 | B2 * | 2/2011 | Lee | 181/148 |
| 8,094,853 | B2 * | 1/2012 | Seki | 381/337 |
| 8,127,885 | B2 * | 3/2012 | Stewart et al. | 181/152 |
| 2003/0123679 | A1 * | 7/2003 | Dudleston et al. | 381/87 |
| 2010/0020144 | A1 * | 1/2010 | McCracken et al. | 347/88 |
| 2011/0308883 | A1 * | 12/2011 | Eaton et al. | 181/224 |

* cited by examiner

*Primary Examiner* — Forrest M Phillips

(57) ABSTRACT

A loudspeaker component includes a unitary plastic element that defines at least a portion of (i) a first acoustic volume that can be acoustically energized by an electro-acoustic driver, (ii) a first port which extends from the first acoustic volume and conducts acoustic energy from the first acoustic volume towards an environment external to a loudspeaker in which the plastic element resides, and (iii) a second port which conducts acoustic energy from a second acoustic volume, defined by the loudspeaker, towards the external environment.

16 Claims, 5 Drawing Sheets

LOUDSPEAKER

BACKGROUND

This disclosure relates to audio devices and in particular to a loudspeaker.

U.S. Pat. No. 5,809,154 discloses a vent loudspeaker system which has at least one active driver and a port opening in a speaker cabinet. Disks or baffle plates are mounted a predetermined distance to and concentric to the port opening, resulting in a vented system.

SUMMARY

In one aspect, a loudspeaker component includes a unitary plastic element that defines at least a portion of (i) a first acoustic volume that can be acoustically energized by an electro-acoustic driver, (ii) a first port which extends from the first acoustic volume and conducts acoustic energy from the first acoustic volume towards an environment external to a loudspeaker in which the plastic element resides, and (iii) a second port which conducts acoustic energy from a second acoustic volume, defined by the loudspeaker, towards the external environment.

Embodiments may include one or more of the following features. The unitary plastic element is arranged so that the electro-acoustic driver can be secured to the plastic element. The unitary plastic element includes features that enable the unitary plastic element and at least three other parts of the loudspeaker to be secured together. The unitary plastic element is designed to reside within the second acoustic volume. The plastic element defines a moat that substantially surrounds an end portion of one of the ports. The end portion of the port extends a greater distance in a direction in which acoustic energy travels than an outer wall of the moat extends in this direction, such that when liquid adhesive is placed in the moat and another loudspeaker part is pressed into the moat, substantially no adhesive will flow into the said one of the ports. The ports are substantially parallel with each other. The first port has a substantially round cross-section at a first end of the first port adjacent to the first acoustic volume. The driver includes an electro-magnetic motor. The first port has a smallest cross-sectional area along the length of the first port with an area A1, a smallest area through which air passes between the motor and a portion of the unitary plastic element that defines the first acoustic volume having an area A2, a ratio of A2/A1>1.

In another aspect, a loudspeaker includes an electro-acoustic driver which creates sound waves when operated and a housing made up of walls. A unitary plastic element defines at least a portion of one or more acoustic elements. The driver is capable of acoustically energizing the one or more acoustic elements. The unitary plastic element is secured to at least two of the walls of the housing.

Embodiments may include one or more of the following features. The one or more acoustic elements include a port. The port has a substantially round cross-section at an end adjacent to the driver. A port exit from the loudspeaker which conducts acoustic energy from the port to the external environment has a substantially rectangular cross-section. The unitary plastic element is secured to at least three walls of the housing. The unitary plastic element is secured to at least one of the walls by a fin on the unitary plastic element being adhered to a slot in the at least one of the walls. The one or more acoustic elements includes a port. The plastic element defines a moat that substantially surrounds an end portion of the port. The end portion of the port extends a greater distance in a direction in which acoustic energy travels than an outer wall of the moat extends in this direction, such that when liquid adhesive is placed in the moat and another loudspeaker part is pressed into the moat, substantially no adhesive will flow into the said one of the ports. The unitary plastic element defines at least a portion of (i) a first acoustic volume that can be acoustically energized by the electro-acoustic driver, (ii) a first port which extends from the first acoustic volume and conducts acoustic energy from the first acoustic volume towards an environment external to the loudspeaker in which the plastic element resides, and (iii) a second port which conducts acoustic energy from a second acoustic volume, defined by the loudspeaker, towards the external environment. The driver includes an electro-magnetic motor. The one or more acoustic elements includes a port having a smallest cross-sectional area along the length of the port with an area A1. A smallest area through which air passes between the motor and a portion of the unitary plastic element that defines an acoustic volume having an area A2, a ratio of A2/A1>1.

In yet another aspect, a loudspeaker includes an electro-acoustic driver which includes an electro-magnetic motor and a port having a smallest cross-sectional area along the length of the port with an area A1. A smallest area through which air passes between the motor and a portion of an element that defines at least a portion of a first acoustic volume has an area A2. A ratio of A2/A1>1.

Embodiments may include one or more of the following features. The motor resides in the first acoustic volume. The port extends from the 1$^{st}$ acoustic volume. A1 is about 13 cm$^2$ and A2 is about 57 cm$^2$. The port is a first port defined by the element that also defines at least a portion of (i) the first acoustic volume that can be acoustically energized by an electro-acoustic driver and (ii) a second port which conducts acoustic energy from a second acoustic volume. The first port extends from the first acoustic volume and conducts acoustic energy from the first acoustic volume towards the external environment. The loudspeaker of further includes a housing made up of walls. The port is at least partially defined by the element. The driver is capable of acoustically energizing the port. The element is secured to at least three of the walls of the housing.

DETAILED DESCRIPTION

Figure 1:
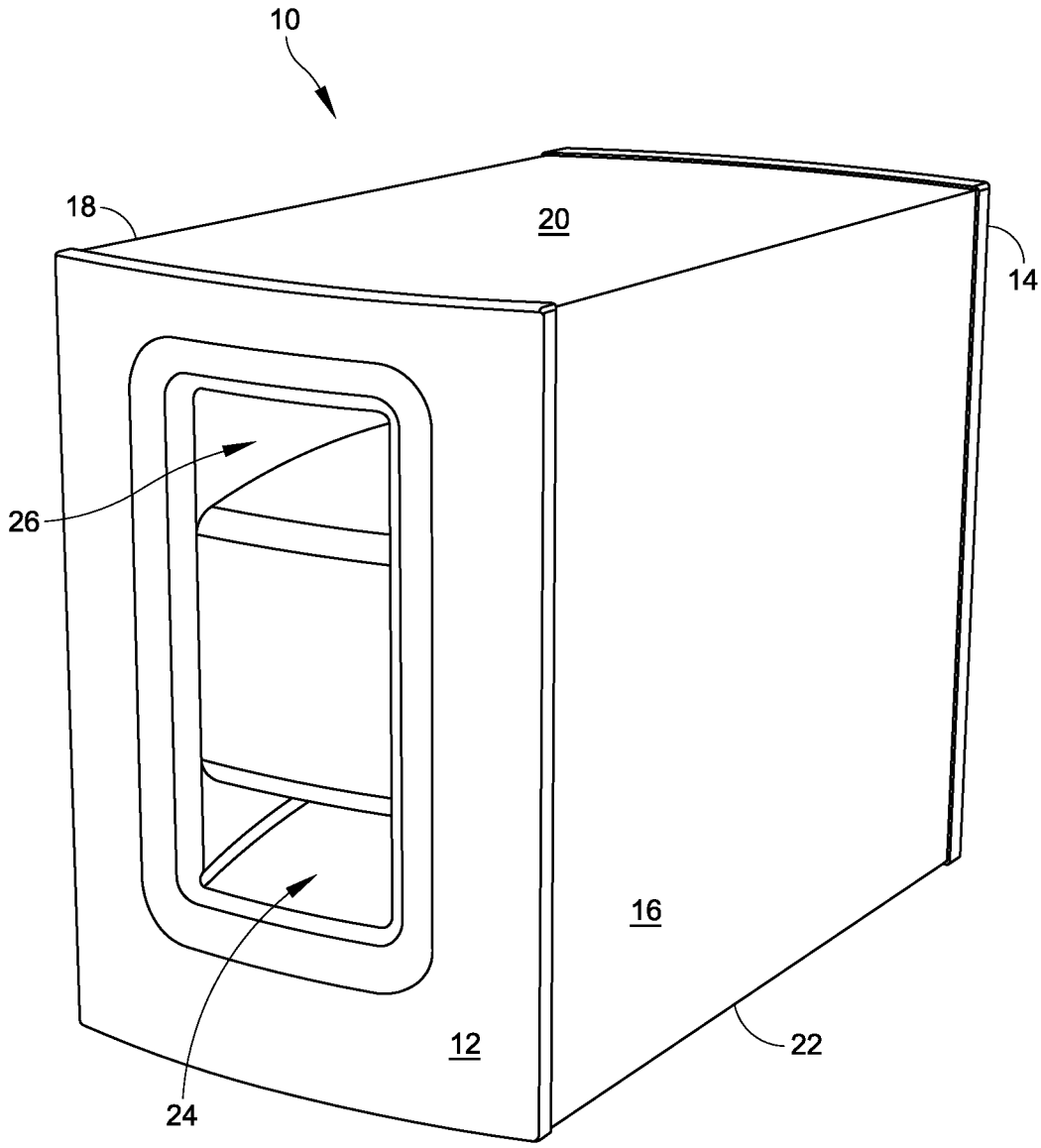
FIG. 1 is perspective view of a loudspeaker as seen from the front, top and right sides.
Figure 2:
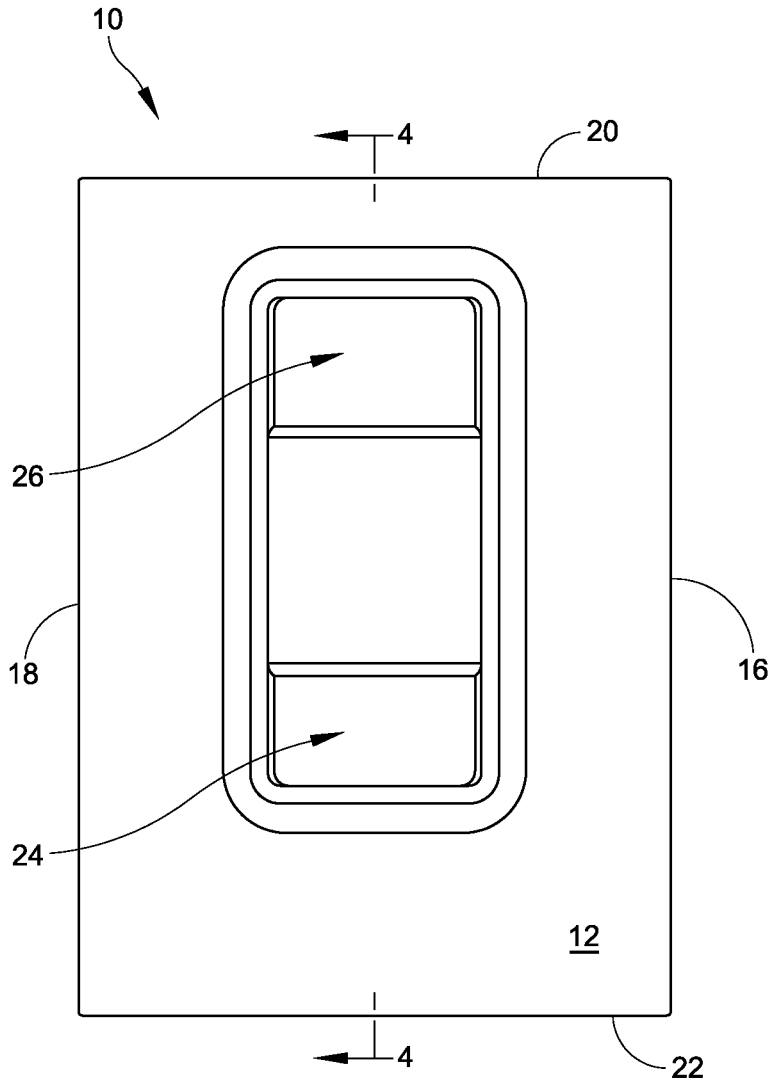
FIG. 2 is a front view of the loudspeaker of FIG. 1.

With reference to FIGS. 1 and 2, a loudspeaker 10 includes front and back walls 12, 14, side walls 16, 18, and top and bottom walls 20, 22. The walls are also referred to as parts of the loudspeaker 10. A high frequency port exit 24 and a low frequency port exit 26 are located in the front wall 12 of the loudspeaker 10. Both of the port exits 24 and 26 have a substantially rectangular cross-section.

Figure 3:
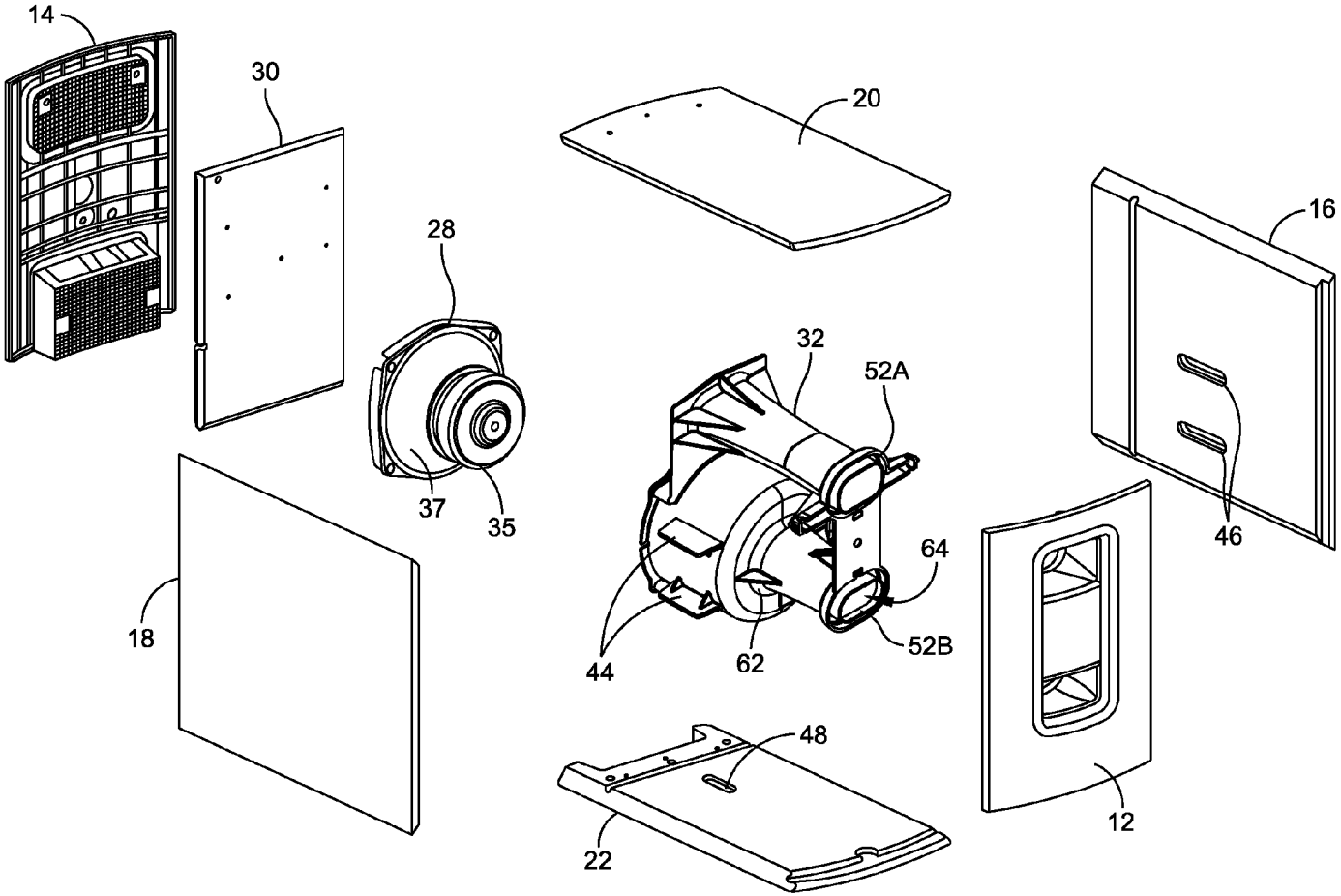
FIG. 3 is an exploded perspective view of the loudspeaker of claim 1 as seen from the front, top and left sides.

Turning to FIG. 3, the walls 12, 14, 16, 18, 20 and 22 of the loudspeaker 10 are shown in an exploded arrangement. An electro-acoustic driver 28 can be operated to create sound waves. An internal wall 30 forms part of an acoustic volume within the loudspeaker 10. A loudspeaker component in the form of a unitary plastic element 32 is also included in the loudspeaker 10.

Figure 4:
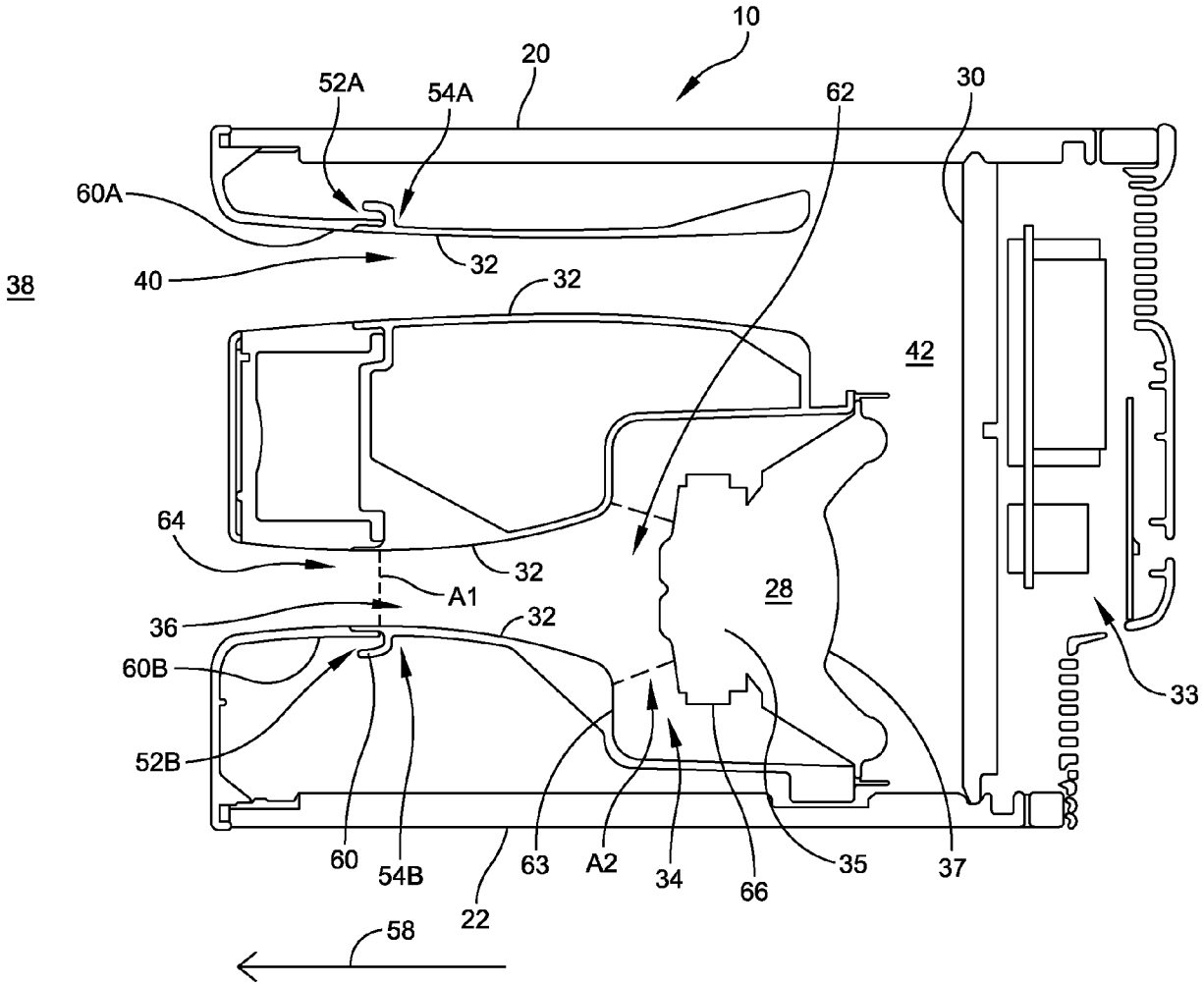
FIG. 4 is a partial sectional view taken along the lines 4-4 of FIG. 2.

Referring now to FIGS. 3 and 4, a space 33 between the back wall 14 and the internal wall 30 contains other parts of the speaker such as the power supply, amplifier and cooling features. Note that the side walls 16, 18, a portion of the front wall 12 and the back wall 14 are not shown in FIG. 4 to facilitate viewing. The plastic element 32 defines at least a portion of a first acoustic volume 34 that can be acoustically energized by the driver 28. The driver 28 is secured to the plastic element by, for example, four fasteners such as screws. The driver includes an electromagnetic motor 35 and a movable cone 37 for creating sound waves. The motor resides in the acoustic volume 34. The plastic element 32 also defines at least a portion of a high frequency port 36 which extends from the first acoustic volume 34 and conducts acoustic energy from the first acoustic volume towards an environment 38 external to the loudspeaker 10 in which the plastic element 32 resides. The plastic element 32 further defines at least a portion of a low frequency port 40 which conducts acoustic energy from a second acoustic volume 42, defined by the side walls 16, 18, top wall 20, bottom wall 22, front wall 12 and internal wall 30 of the loudspeaker 10, towards the external environment 38. Note that the ports 36 and 40 are substantially parallel with each other. The plastic element 32 is designed to reside within the acoustic volume 42. The ports 36 and 40, and the acoustic volume 34 are also known as acoustic elements. When operated, the driver 28 can acoustically energize the acoustic elements.

The unitary plastic element 32 includes fins 44 that enable the element 32 to be secured to the wall 18 by using adhesive to adhere the fins 44 into two slots (not shown) on the inside of the wall 18. These two slots are similar to two slots 46 on the inside of the wall 16 to which two fins (not shown) on the plastic element 32 are secured with adhesive. These two fins which are not shown in the figures are similar to the fins 44 and are on the opposite side of the element 32 compared to the fins 44. A bottom fin (not shown) on the element 32 is secured to a slot 48 in the bottom wall 22 with adhesive. A front portion of the element 32 is secured to the front wall 12 with adhesive (this will be described in further detail below). In this example the unitary plastic element 32 is secured to four walls of the loudspeaker 10. In other examples the element 32 can be secured to a lesser number of walls such as two or three walls. For example, element 32 might only be secured to walls 16 and 18. The element 32 might be secured to another part of the loudspeaker 10 besides a wall.

Figure 5:
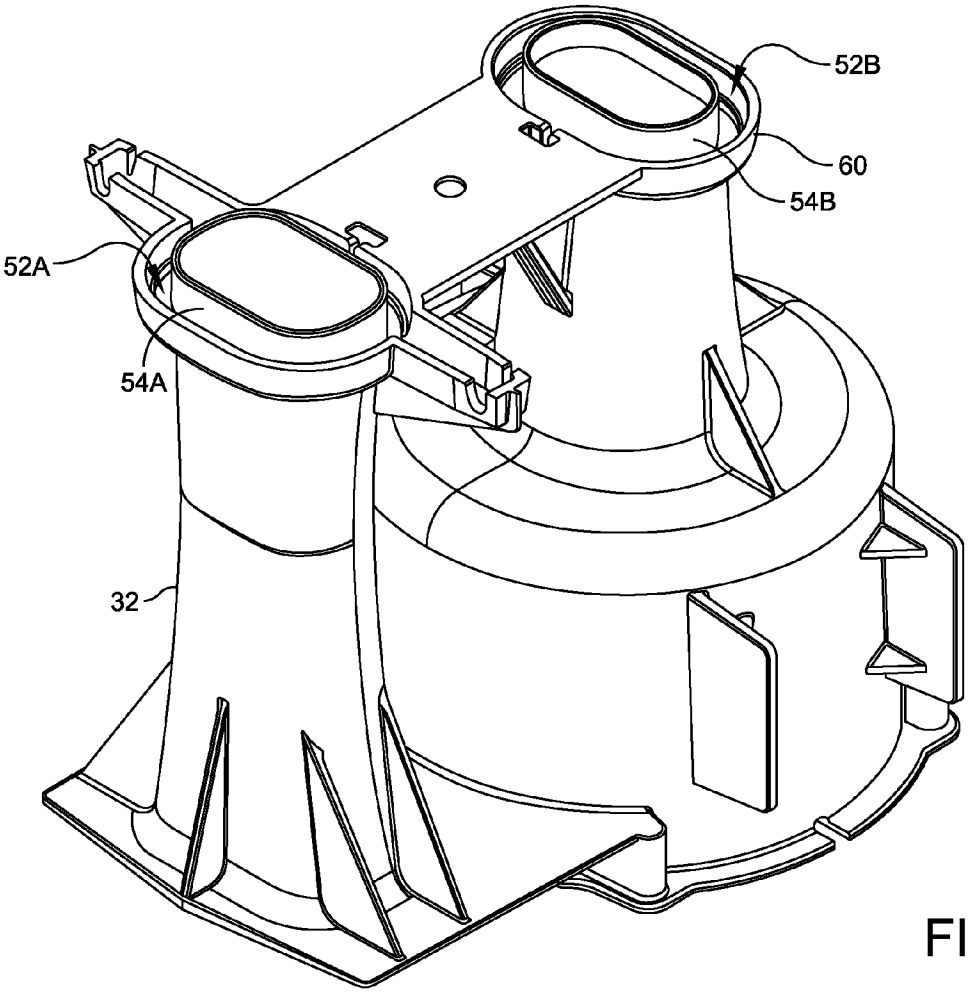
FIG. 5 is a perspective view of a unitary plastic element of the loudspeaker of FIG. 1

With reference to FIGS. 3-5, plastic element 32 defines moats 52A and 52B that respectively substantially surround end portions 54A and 54B of ports 40 and 36. These moats are substantially similar in this example, so only one of the moats will be described in further detail. Regarding moat 52B, the end portion 54B of the port 36 extends a greater distance in a direction 58 in which acoustic energy travels than an outer wall 60 of the moat 52B extends in this direction. During assembly of the loudspeaker 10, the element 32 is oriented such that direction 58 is substantially upwardly vertical. A liquid adhesive is then placed in each of the moats 52A and 52B. Respective portions 60A and 60B of the front wall 12 are pressed into the moats 52A and 52B. As a result of this arrangement, any excess adhesive will spill over the outer wall (e.g. wall 60) of each moat and will not spill over the end portion (e.g. end portion 36) of each port. This is due to the fact that when the element 32 is oriented so the direction 58 is upwardly vertical, the end portion (e.g. end portion 36) of each port is higher than the outer wall (e.g. wall 60) of each moat. As a result, substantially no adhesive will flow into the ports, resulting in reduced audio artifacts such as whistling.

The port 36 has a substantially round cross-section at a first end 62 (a port entrance) of the first port adjacent to the first acoustic volume when viewed in direction 58. A second end 64 of the port 36 has a substantially racetrack shaped cross-section when viewed in direction 58. The port entrance 62 is adjacent to the motor 35. A smallest cross-sectional area along the length of the port 36 has an area A1. As the cone 37 vibrates back and forth, it causes air to move back and forth in volumes 34 and 42. The air passes through a smallest area A2 between the motor 35 and a portion 63 of the unitary plastic element 32 that defines the volume 34. In this example A2 is the outer surface area of an imaginary truncated cone. In this example A1 is about 13 $cm^2$ and A2 is about 57 $cm^2$. It is preferable for a ratio of A2/A1>1. This arrangement of the motor 35 and the port entrance 62 provides the benefit of efficient packaging which results in a relatively small sized loudspeaker. The driver is mounted to the element 32 so that the motor 35 resides in the acoustic volume 34, thus reducing an overall length of the loudspeaker 10 in a direction 58. Having a round port entrance 62 allows a round motor structure of motor 35 to get relatively close to the port entrance without producing unwanted noise.

A number of implementations have been described. Nevertheless, it will be understood that additional modifications may be made without departing from the spirit and scope of the inventive concepts described herein, and, accordingly, other embodiments are within the scope of the following claims.

What is claimed is:

1. A loudspeaker component, comprising:

an electro-acoustic driver;

a unitary plastic element that defines at least a portion of (i) a first acoustic volume that can be acoustically energized by the electro-acoustic driver, (ii) a first port which extends from the first acoustic volume and conducts acoustic energy from the first acoustic volume towards an environment external to a loudspeaker in which the plastic element resides, and (iii) a second port which conducts acoustic energy from a second acoustic volume, defined by the loudspeaker, towards the external environment, the first acoustic volume being located on a first side of the driver and the second acoustic volume being located on a second side of the driver, the first and second ports being substantially parallel with each other along at least a portion of their length, and wherein acoustic energy enters the external environment in substantially the same direction from the first and second ports.

2. The loudspeaker component of claim 1, wherein the unitary plastic element is arranged so that the electro-acoustic driver can be secured to the plastic element.

3. The loudspeaker component of claim 1, wherein the unitary plastic element includes features that enable the unitary plastic element and at least three other parts of the loudspeaker to be secured together.

4. The loudspeaker component of claim 1, wherein the unitary plastic element is designed to reside within the second acoustic volume.

5. The loudspeaker component of claim 1, wherein the plastic element defines a moat that substantially surrounds an end portion of one of the ports, the end portion of the port extending a greater distance in a direction in which acoustic energy travels than an outer wall of the moat extends in this direction, such that when liquid adhesive is placed in the moat and another loudspeaker part is pressed into the moat, substantially no adhesive will flow into the said one of the ports.

6. The loudspeaker component of claim 1, wherein the ports are substantially parallel with each other.

7. The loudspeaker component of claim 1, wherein the first port has a substantially round cross-section at a first end of the first port adjacent to the first acoustic volume.

8. The speaker component of claim 1, wherein the driver includes an electro-magnetic motor, the first port having a smallest cross-sectional area along the length of the first port with an area A1, a smallest area through which air passes between the motor and a portion of the unitary plastic element that defines the first acoustic volume having an area A2, a ratio of A2/A1>1.

9. A loudspeaker, comprising:

an electro-acoustic driver which creates sound waves when operated;

a housing made up of walls; and a unitary plastic element that defines at least a portion of one or more acoustic elements, the acoustic elements including (i) a first acoustic volume that can be acoustically energized by the electro-acoustic driver, (ii) a first port which extends from the first acoustic volume and conducts acoustic energy from the first acoustic volume towards an environment external to the loudspeaker in which the plastic element resides, and (iii) a second port which conducts acoustic energy from a second acoustic volume, defined by the loudspeaker, towards the external environment, the driver being capable of acoustically energizing the one or more acoustic elements; the unitary plastic element being secured to at least two of the walls of the housing, wherein the unitary plastic element is secured to at least one of the walls by a fin on the unitary plastic element being adhered to a slot in the at least one of the walls, the first acoustic volume being located on a first side of the driver and the second acoustic volume being located on a second side of the driver, the first and second ports being substantially parallel with each other along at least a portion of their length, and wherein acoustic energy enters the external environment in substantially the same direction from the first and second ports.

10. The loudspeaker of claim 9, wherein the first port has a substantially round cross-section at an end adjacent to the driver, a port exit from the loudspeaker which conducts acoustic energy from the first port to the external environment having a substantially rectangular cross-section.

11. The loudspeaker of claim 9, wherein the unitary plastic element is secured to at least three walls of the housing.

12. The loudspeaker of claim 9, wherein the plastic element defines a moat that substantially surrounds an end portion of one of the ports, the end portion of the said one of the ports extending a greater distance in a direction in which acoustic energy travels than an outer wall of the moat extends in this direction, such that when liquid adhesive is placed in the moat and another loudspeaker part is pressed into the moat, substantially no adhesive will flow into the said one of the ports.

13. The loudspeaker of claim 9, wherein the driver includes an electro-magnetic motor, the first port having a smallest cross-sectional area along the length of the first port with an area A1, a smallest area through which air passes between the motor and a portion of the unitary plastic element that defines an the first acoustic volume having an area A2, a ratio of A2/A1>1.

14. A loudspeaker, comprising:

an electro-acoustic driver which includes an electro-magnetic motor;

a first port having a smallest cross-sectional area along the length of the port with an area A1, a smallest area through which air passes between the motor and a portion of an element that defines at least a portion of a first acoustic volume having an area A2, a ratio of A2/A1>1; and a second port which conducts acoustic energy from the driver towards an environment external to the loudspeaker, the first and second ports are substantially parallel with each other along at least a portion of their length, a second acoustic volume being defined by the loudspeaker and acoustically connected to the second port, the first acoustic volume being located on a first side of the driver and the second acoustic volume being located on a second side of the driver, and wherein acoustic energy enters the external environment in substantially the same direction from the first and second ports.

15. The loudspeaker of claim 14, wherein the motor resides in the first acoustic volume, the first port extending from the first acoustic volume.

16. The loudspeaker of claim 14, wherein A1 is about $13cm^2$ and A2 is about $57cm^2$.

* * * * *